US009293282B2

(12) United States Patent
Schaltenbrand et al.

(10) Patent No.: US 9,293,282 B2
(45) Date of Patent: Mar. 22, 2016

(54) MOVING SEAL WITH ARC CREEPAGE SURFACE FOR AN AIR CIRCUIT BREAKER

(71) Applicant: Eaton Corporation, Cleveland, OH (US)

(72) Inventors: Brian John Schaltenbrand, Pittsburgh, PA (US); Mark Anthony Janusek, Pittsburgh, PA (US); Robert William Mueller, Aliquippa, PA (US); James Michael Smeltzer, Salem, OH (US); William Michael Randal, Pittsburgh, PA (US)

(73) Assignee: EATON CORPORATION, Cleveland, OH (US)

( * ) Notice: Subject to any disclaimer, the term of this patent is extended or adjusted under 35 U.S.C. 154(b) by 169 days.

(21) Appl. No.: 14/074,754

(22) Filed: Nov. 8, 2013

(65) Prior Publication Data

US 2014/0069892 A1 Mar. 13, 2014

Related U.S. Application Data

(63) Continuation-in-part of application No. 12/816,431, filed on Jun. 16, 2010, now abandoned.

(51) Int. Cl.

| | |
|---|---|
| ***H01H 9/32*** | (2006.01) |
| ***H01H 73/18*** | (2006.01) |
| ***H01H 33/70*** | (2006.01) |

(Continued)

(52) U.S. Cl.

CPC ..... *H01H 33/7069* (2013.01); *H01H 9/32* (2013.01); *H01H 73/18* (2013.01); *H01H 1/226* (2013.01); *H01H 2009/305* (2013.01); *H01H 2050/028* (2013.01)

(58) Field of Classification Search

CPC ..... H01H 73/18; H01H 9/32; H01H 33/7069; H01H 1/226; H01H 1/54

USPC ..... 218/15, 34–41, 146–149, 156–158; 200/244, 250, 400, 401; 335/201–204

See application file for complete search history.

(56) References Cited

U.S. PATENT DOCUMENTS

| | | | |
|---|---|---|---|
| 5,899,323 | A | 5/1999 | Rakus |
| 5,969,314 | A | 10/1999 | Rakus et al. |

(Continued)

FOREIGN PATENT DOCUMENTS

| | | | |
|---|---|---|---|
| EP | 2 398 033 | A2 | 12/2011 |
| EP | 2 541 573 | A1 | 1/2013 |
| WO | 02/27739 | A1 | 4/2002 |

OTHER PUBLICATIONS

European Patent Office, "International Search Report and Written Opinion", Feb. 3, 2015, 11 pp.

(Continued)

*Primary Examiner* — Amy Cohen Johnson
*Assistant Examiner* — Marina Fishman
(74) *Attorney, Agent, or Firm* — Eckert Seamans Cherin & Mellott, LLC; David C. Jenkins; Grant E. Coffield

(57) ABSTRACT

A moving seal for an air circuit breaker provides an arc creepage surface that is positioned between a pair of separable contact assemblies when the moving seal is fit into an inlet of the arc chamber. The arc creepage surface has a surface contour that increases a length of an arc travel path between the separable contact assemblies, relative to a straight line distance between of separable contact assemblies.

16 Claims, 5 Drawing Sheets

(51) Int. Cl.

| | |
|---|---|
| *H01H 1/22* | (2006.01) |
| *H01H 9/30* | (2006.01) |
| *H01H 50/02* | (2006.01) |

(56) References Cited

U.S. PATENT DOCUMENTS

| | | | |
|---|---|---|---|
| 6,005,206 | A | 12/1999 | Rakus et al. |
| 6,930,577 | B2 | 8/2005 | Subramanian et al. |
| 7,105,764 | B2 | 9/2006 | Rakus et al. |
| 7,265,311 | B1 | 9/2007 | Schaltenbrand et al. |
| 2005/0035835 | A1 | 2/2005 | Liebetruth et al. |

OTHER PUBLICATIONS

European Search Report, issued in co-pending European Patent Application No. 11004896.4, European Patent Application Filing Date Jun. 15, 2011, having a date of May 23, 2012, 9 pgs.

MOVING SEAL WITH ARC CREEPAGE SURFACE FOR AN AIR CIRCUIT BREAKER

CROSS REFERENCE TO RELATED APPLICATION

This application is a continuation-in-part application of and claims priority to U.S. patent application Ser. No. 12/816,431, filed Jun. 16, 2010 entitled MOVING SEAL WITH ARC CREEPAGE SURFACE FOR AN AIR CIRCUIT BREAKER.

BACKGROUND

Electrical switching apparatus for power distribution systems include devices such as circuit breakers, network protectors, transfer switches and disconnect switches. A common type of circuit breaker is the air circuit breaker, which uses a flow of gas to extinguish the arc caused by separation of the contacts. The flow of gas may be provided by a source of compressed gas or by air exiting a sealed arc chamber that is pressurized when the contacts separate. The pressurization of the arc chamber may be accomplished by a moving seal that acts in cooperation with a contact carriage that carries the moveable contact away from the stationary contact. The moving seal moves into the arc chamber when the contacts separate, displacing air in the arc chamber. The air flows out of the arc chamber through an arc chute and extinguishes the arc. The moving seal is typically positioned near the stationary contact so that it can property extinguish the arc. However, this close proximity may allow the arc to creep up the moving seal and short to the contact carriage, causing a short circuit condition.

SUMMARY

A moving seal for an air circuit breaker is provided that includes a sealing portion having an arc creepage surface that is positioned between first and second circuit breaker contacts when the sealing portion is fit into an inlet of an arc chamber enclosing the first and second circuit breaker contacts. The arc creepage surface has a surface contour that increases the length of an arc travel path between the second circuit breaker contact and a contact carriage that carries the first circuit breaker contact, relative to a straight line distance between the second circuit breaker contact and the contact carriage. The arc creepage surface may have a substantially concave surface contour that includes a single concave groove or a plurality of parallel concave grooves.

In some example embodiments, the moving seal also includes an actuation portion configured to co-act with the contact carriage, where the contact carriage is operable to separate the first and second circuit breaker contacts. In these example embodiments, the arc chamber is substantially closed and the inlet is formed between the first and second circuit breaker contacts when the contact carriage carries the first circuit breaker contact away from the second circuit breaker contact. The sealing portion of the moving seal is configured to fit within the inlet opening to seal the inlet and define a portion of the arc chamber. The actuation portion is operable to selectively position the sealing portion in the inlet when the contact carriage carries the first circuit breaker contact away from the second circuit breaker contact.

In another embodiment, an air circuit breaker is provided that includes a substantially closed arc chamber enclosing a pair of separable contact assemblies. The arc chamber includes an inlet that is formed between the pair of separable contact assemblies when the separable contact assemblies are separated. The air circuit breaker includes a moving seal configured to be fit within the inlet to close the inlet and define a portion of the arc chamber. The moving seal includes an arc creepage surface that is positioned between the pair of separable contact assemblies when the moving seal is fit into the inlet. The arc creepage surface has a surface contour that increases the length of an arc travel path between the pair of separable contact assemblies, relative to a straight line distance between the pair of separable contact assemblies. The arc creepage surface may have a substantially concave surface contour that includes a single concave groove or a plurality of parallel concave grooves.

BRIEF DESCRIPTION OF THE DRAWINGS

The accompanying drawings, which are incorporated in and constitute a part of the specification, illustrate various example systems, methods, and other embodiments of various aspects of the invention. One of ordinary skill in the art will appreciate that in some embodiments one element may be designed as multiple elements, multiple elements may be designed as one element, an element shown as an internal component of another element may be implemented as an external component and vice versa, and so on. Furthermore, elements may not be drawn to scale.

DETAILED DESCRIPTION

Figure 1:
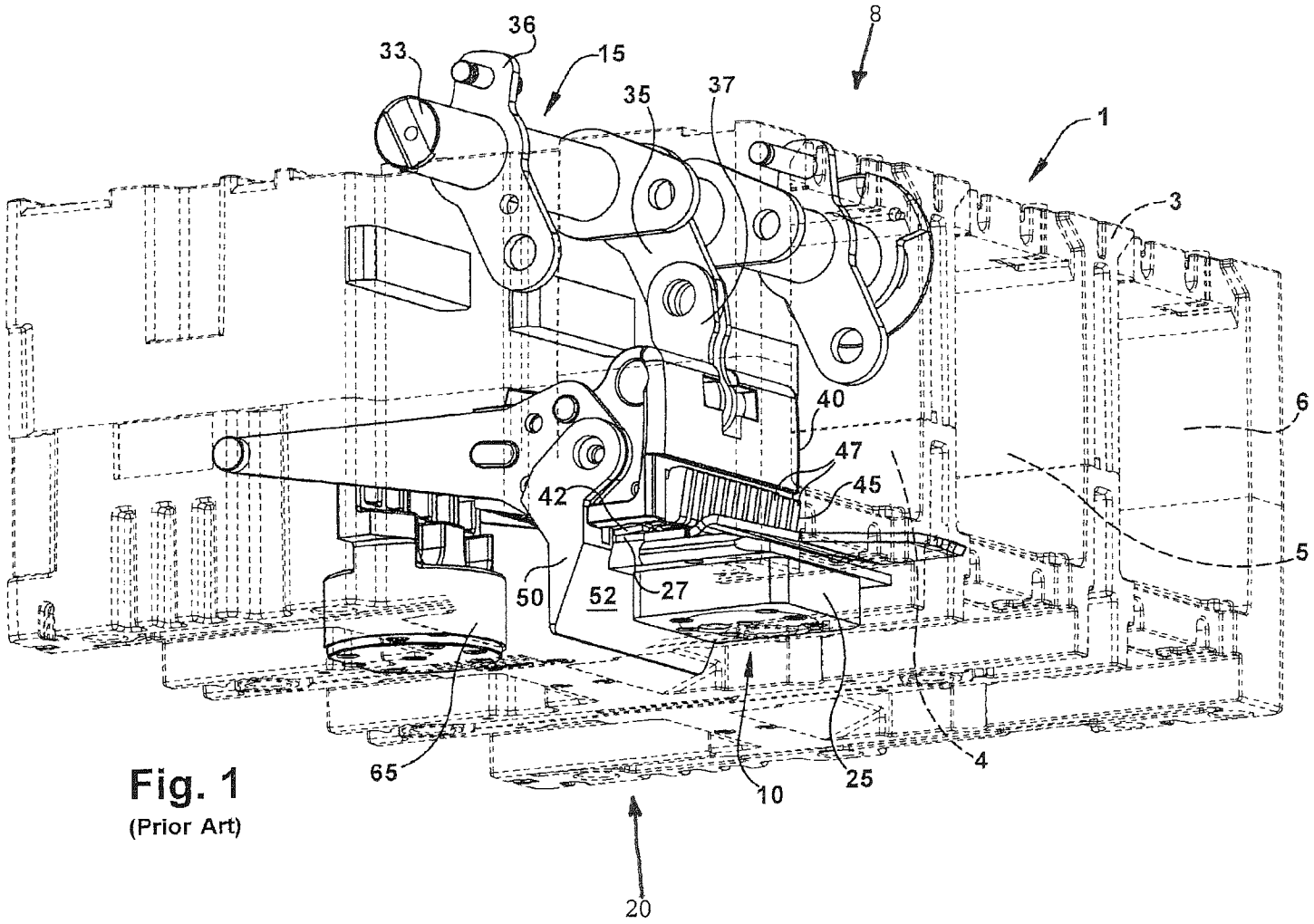
Fig. 1 (Prior Art)
FIG. 1 illustrates a prior art three pole air circuit breaker with a moving seal.

Directional phrases used herein, such as, for example, clockwise, counterclockwise, left, right, upper, lower, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the statement that two or more parts or components "engage" one another shall mean that the elements exert a force or bias against one another either directly or through one or more intermediate elements or components.

As used herein, the word "unitary" means a component is created as a single piece or unit. That is, a component that includes pieces that are created separately and which are then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit. Further, as used herein, "loosely correspond" means that an opening is sized to be larger than an element disposed therein, i.e. there is a gap between the two elements. This means that the increased size of the slot or opening is intentional and is more than a manufacturing tolerance. Further, with regard to a surface formed by two or more elements, a "corresponding" shape means that surface features, e.g. curvature, are similar.

As used herein, an "extended surface" is a surface that is non planar. For example, a planar surface extending between two parallel lines provides the shortest path between the two lines, e.g. a path extending generally perpendicular to the lines. An "extended surface" is non-planar and, as such, even a path extending generally perpendicular to the lines provides a longer path than a planar surface.

A prior art air circuit breaker 1 is illustrated in FIG. 1. The air circuit breaker includes a housing assembly 3 (shown in dashed line) that forms three generally tubular pole chambers 4, 5, 6, each configured to house a circuit breaker pole 10 (only one pole 10 is shown in solid line in FIG. 1). An operating mechanism 15 is mounted to a front end of the housing assembly 3. The operating mechanism 15 is common to all three circuit breaker poles 10 and is connected to the individual poles by a pole shaft 33 that has a lobe 35 for each pole. The operating mechanism 15 includes a trip unit (not shown) that actuates the operating mechanism 15 to open all the poles of the circuit breaker 8 through rotation of the pole shaft 33 in response to predetermined characteristics of the current flowing through the circuit breaker. In addition, the operating mechanism 15 may be manually actuated by way of a switch lobe portion 36. The switch lobe portion 36 is connected to a number of manually operable switches (not shown) that are accessible outside the housing assembly 3.

Figure 4:
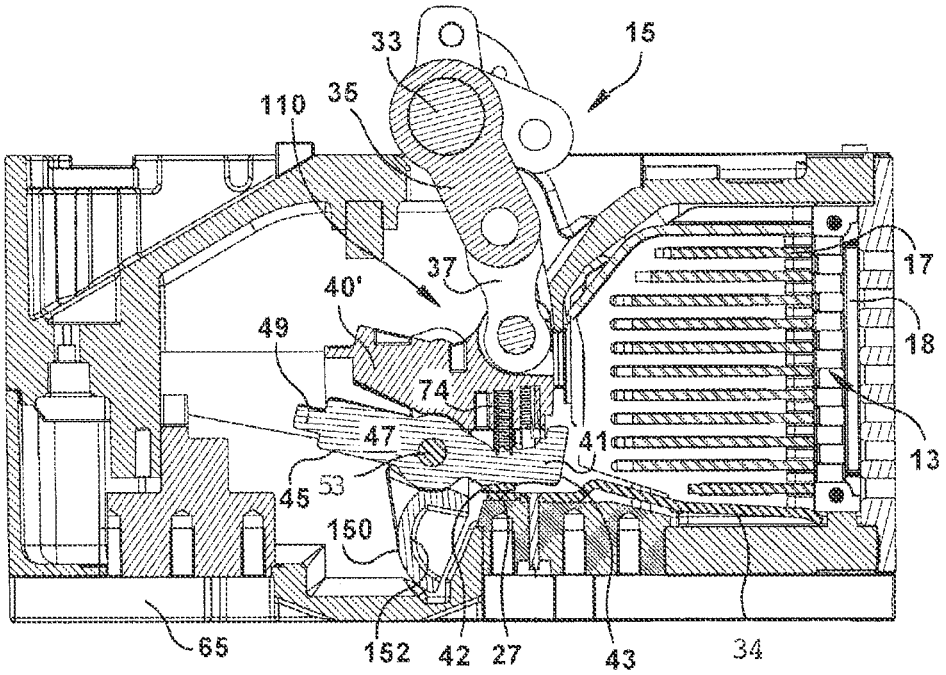
FIG. 4 is a cross section of the air circuit breaker taken along 4-4 as indicated in FIG. 3 with a pole assembly in a closed or conducting position.
Figure 5:
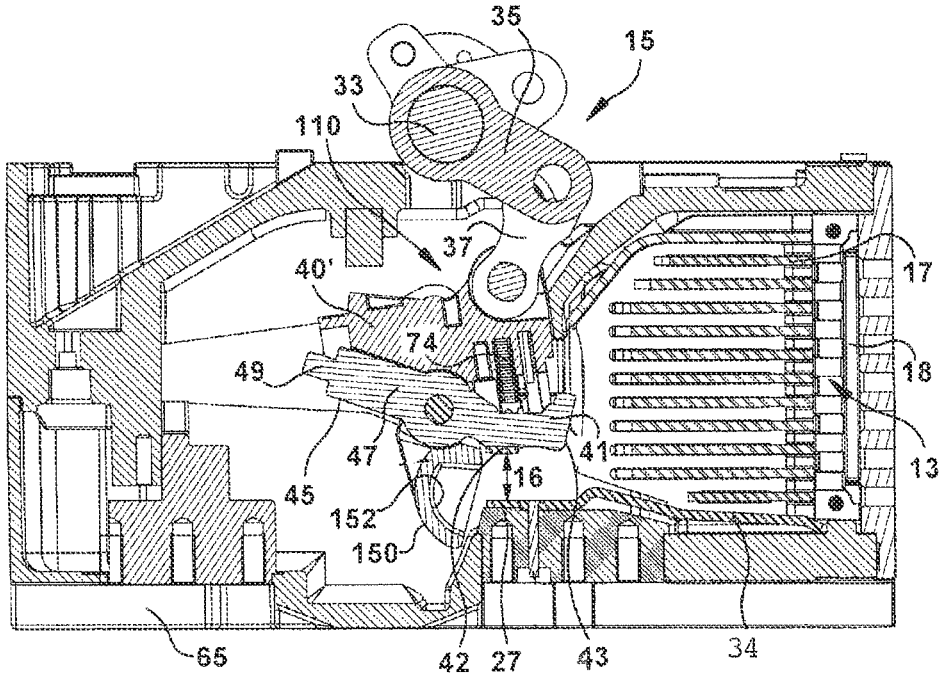
FIG. 5 is a cross section of the air circuit breaker taken along 4-4 as indicated in FIG. 3 with a pole assembly in an intermediate contact separation position.

In an exemplary embodiment, a circuit breaker 8 includes a number of generally tubular pole chambers 4, 5, 6, in each of which a pole 110 is disposed. A portion of each pole chamber 4, 5, 6 is an arc chamber (FIGS. 4 and 5). Each pole 110, which will be described in more detail below, includes a stationary contact assembly 25 configured to be connected to a line conductor (not shown) that projects rearwardly from the housing assembly 3. The pole 110 also includes a movable contact assembly 45 that is mounted to a contact carriage 40. The contact carriage 40 is operable to carry the moveable contact assembly 45 away from the stationary contact assembly 25. The moveable contact assembly 45 includes a plurality of contact fingers 47 that are pivotally mounted to the contact carriage 40. When the circuit breaker 8 is closed, the moveable contact assembly 45 provides a current path between the stationary contact assembly 25 and a load conductor connector assembly 65 configured to be connected to a load conductor (not shown).

The current path includes a stationary contact 27, a moveable contact 42 and a flexible shunt (not shown) connected to bottom end 49 shunt connection feature (FIG. 4) of the contact fingers 47. That is, each pole 110 includes a number of pairs of separable contacts 20. Each pair of separable contacts 20 includes a stationary first contact 27 and a movable second contact 42, wherein each pair of contacts 20 move between an open, first position and a closed, second position. In an exemplary embodiment, each contact 27, 42 includes a generally planar surface, or "face" 28, 29, respectively, wherein the contacts 27, 42 are directly coupled. Each pole 110, and therefore, each pair of separable contacts 20 is disposed in an associated pole chamber 4, 5, 6. Further, the number of pairs of contacts 20 define a plane of separation, i.e. a plane that extends through all the contacts 20 when the contacts 20 are in the first position. The plane of separation is generally perpendicular to the planes defined by the contact faces 28, 29. In an exemplary embodiment, the plane of separation of the separable contacts 20 extends generally laterally across the housing assembly 3. Similarly, the contact carriage 40 moves between a first position and a second position corresponding to the separable contact 20 first and second positions.

A number of moving seals 50 are also pivotally coupled to the moveable contact carriage 40. In an exemplary embodiment, there is one moving seal 50 disposed in each pole chamber 4, 5, 6 adjacent an arc chamber 13. As each moving seal 50 is substantially similar, only one is described hereinafter. The moving seal 50 includes a body 51. The moving seal body 51 includes a sealing surface 52 that forms one portion of a sealed arc chamber (not visible in FIG. 1). The moving seal 50 moves between a first position, wherein the moving seal body 51 is disposed in a medial portion of an associated pole chamber 5, and a second position. wherein the moving seal body 51 is disposed in an offset portion of the associated pole chamber 5. That is, when the contact carriage 40 separates, i.e. moves from the second position to the first position, each moving seal 50 pressurizes the arc chamber 13 and extinguish the arc.

Figure 1A:
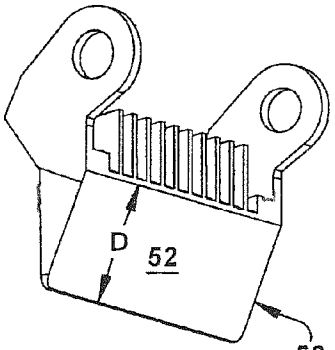
Fig. 1A (Prior Art)
FIG. 1A is a perspective view of the moving seal in the air circuit breaker shown in FIG. 1.

As can be seen best in FIG. 1A, the sealing surface 52 of a prior art moving seal 50 is substantially planar and presents a straight line path for the arc to travel when the contacts 20 are separated. This may cause the moving seal 50 to be susceptible to shorting due to arc creepage as discussed in the background section. This is because the planar sealing surface 52 provides a relatively short straight line path, labeled "D," between the contact carriage 40 and the stationary contact 27 during contact separation. It is noted that not all portions of the moving seal 50 are exposed to the arc. That is, as the arc only forms after the contacts 27, 42 separate, i.e. when the moving seal is moving from the second position to the first position, a forward facing portion 48 of the moving seal 50 is not exposed to the arc. Accordingly, and as used herein, any portion of the moving seal 50 that is generally in, or "above" (wherein the moving seal 50 moves "up" when moving from the second position to the first position) the plane of the contact faces 28, 29 when the contacts 20 are in the second position, is not part of the "sealing surface" 52 or the "arc creepage surface."

Figure 2A:
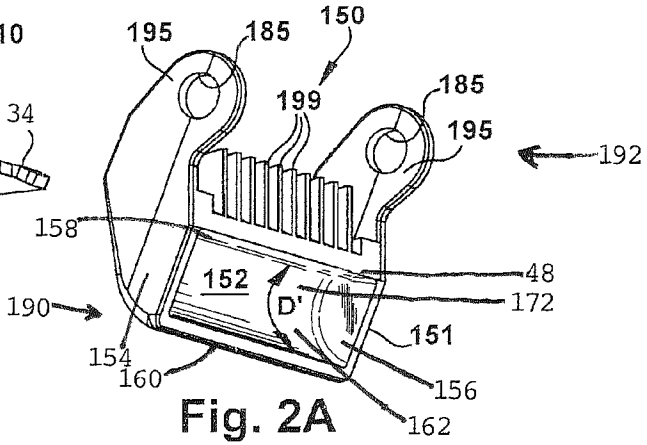
FIG. 2A is a perspective view of the moving seal with arc creepage surface in the pole shown in FIG. 2.
Figure 2:
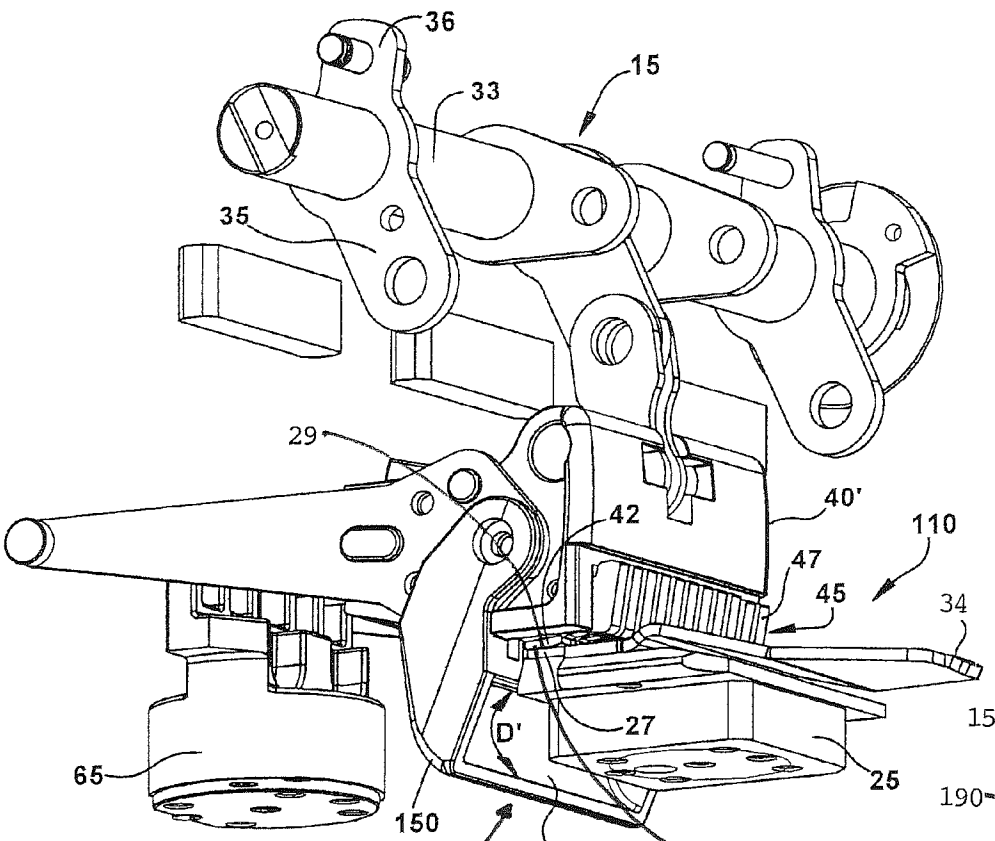
FIG. 2 is a perspective view of a single circuit breaker pole that includes an example embodiment of a moving seal with an arc creepage surface.

FIG. 2 illustrates a circuit breaker pole 110 that includes many of the same components as the pole 10 shown in FIG. 1 and which are assigned the same reference numeral as in FIG. 1. The contact carriage 40' includes a moving seal 150 including a body 151 with an arc creepage surface 152, two lateral sidewalls 154, 156 as well as an upper sidewall 158, and a lower sidewall 160. In an exemplary embodiment, the width of the moving seal body 151 substantially corresponds to the width of a pole chamber 5. The arc creepage surface 152 is an extended surface. Thus, the arc creepage surface 152 is configured to increase the distance ("D'"), relative to the distance presented by the planar sealing surface 52, that the arc must travel along the arc creepage surface 152 before shorting to the contact carriage 40' while still providing an adequate amount of pressurization of the arc chamber to extinguish the arc. It will be appreciated that the arc creepage surface 152 could be embodied in any configuration that increases the distance, relative to the straight line distance D presented by the planar sealing surface 52, that the arc must travel along the moving seal 150 before shorting to the contact carriage 40'. Further, the moving seal 150 includes a sealing portion 190 and an actuation portion 192. The sealing portion 190 includes the arc creepage surface 152 as well as fins 199 that extend behind the arc creepage surface 152. It is noted, however, that the fins 199 are not part of the creepage surface 152.

In an exemplary embodiment, the arc creepage surface 152 includes a concave portion 162 relative to the separable contacts 20. As used herein, "concave" means a cavity, or other generally empty space, wherein the surface defining the cavity extends away from the contacts 20 when the moving seal 150 is in the first position, described below. Further, as used herein, a single, generally planar member cannot form a "concave" portion or surface. In an exemplary embodiment, shown in FIG. 2A, the arc creepage surface 152 is an arcuate surface 170 that extends substantially between the moving seal body upper sidewall 158 and the lower sidewall 160. Stated alternately, there is a single laterally extending groove. Further, in an exemplary embodiment, the arc creepage surface 152 includes a planar portion 172. The arc creepage surface planar portion 172 extends generally perpendicular to the plane of separation of the separable contacts. In an exemplary embodiment, the arc creepage surface concave portion 162 is generally smooth.

Figure 6:
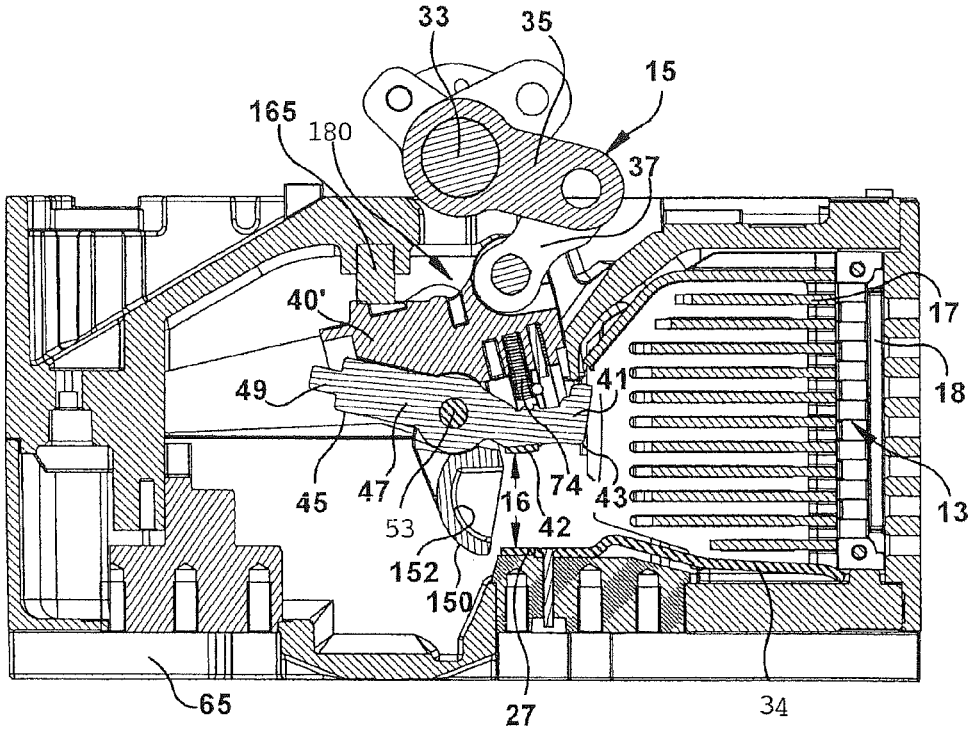
FIG. 6 is a cross section of the air circuit breaker taken along 4-4 as indicated in FIG. 3 with a pole assembly in an open or non-conducting position.
Figure 7:
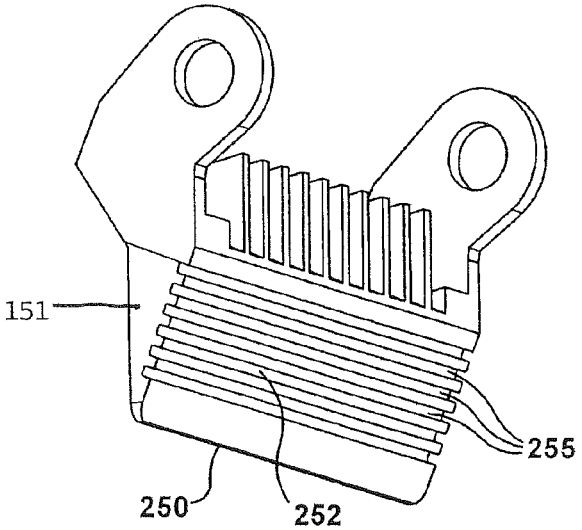
FIG. 7 is a perspective view of another example embodiment of a moving seal that includes an arc creepage surface.

FIG. 7 illustrates an alternative embodiment of a moving seal 250 with an arc creepage surface 252 that includes a plurality of generally lateral, generally parallel concave grooves 255. Like the concave arc creepage surface 152 of FIGS. 2-6, the grooved arc creepage surface 252 increases the distance, relative to the distance D presented by the planar seating surface 52 (FIG. 1A), that the arc must travel along the moving seal 250 before shorting to the contact fingers 47 (FIGS. 4-6). In an exemplary embodiment, the plurality of parallel concave grooves 255 are defined by one of a number of ridges extending from a generally planar arc creepage surface, or, a number of channels in said generally planar arc creepage surface. That is, as used herein, a "generally" planar surface includes the plurality of parallel concave grooves 255. A planar surface without a plurality of parallel concave grooves 255 is "substantially" planar. In an exemplary embodiment, the arc creepage surface concave portion 162, shown in FIG. 2A, includes a plurality of generally lateral, generally parallel concave grooves 255 as shown in FIG. 7.

While three alternative embodiments of an arc creepage surface are described herein, it will be appreciated that the arc creepage surface could be embodied in any configuration that increases the distance that the arc must travel along the moving seal before shorting to the contact fingers 47. For example, a generally planar arc creepage surface including a number of dimples, convex or concave, would define an extended surface.

The sealing portion 190 is structured to be positioned adjacent the stationary contact 27 (FIG. 2) when the contact carriage 40 is in the first position. That is, as the contacts 20 move from the second position to the first, and as the contact carriage 40' moves from the second position to the first, the moving seal 150 moves from its second position to its first position. In this position, the arc creepage surface 152 defines a portion of the arc chamber when the arc is being extinguished (FIG. 5). Stated alternately, the arc creepage surface 152 defines a medial wall 180 (FIG. 6) within a pole chamber 5. As the width of the moving seal body 151 substantially corresponds to the width of the pole chamber 5, the medial wall 180 substantially fills the pole chamber 5 adjacent the contacts 20 when the moving seal is in the second position.

The actuation portion 192 includes spaced legs 195 that have circular recesses 185 that engage the ends of a pivot pin 53 (FIG. 4) to secure the moving seal 150 to the contact carriage 40' as seen in FIG. 2. The pivot pin 53 is also used to pivotally mount the contact fingers 27 to the contact carriage 40'. Thus, the moving seal 150, by way of the actuation portion, co-acts with the contact carriage 40' to position the moving seal 150 between the contact carriage and the stationary contact 27 when the contacts separate. When assembled to the pole 110, the fins 199 on the moving seal 150 extend between the contact fingers 47 and align with fins (not shown) arranged between the contact fingers on the contact carriage 40' to form a seal which prevents the flow of arc gases from passing through the spaces between the contact fingers 47.

Figure 3:
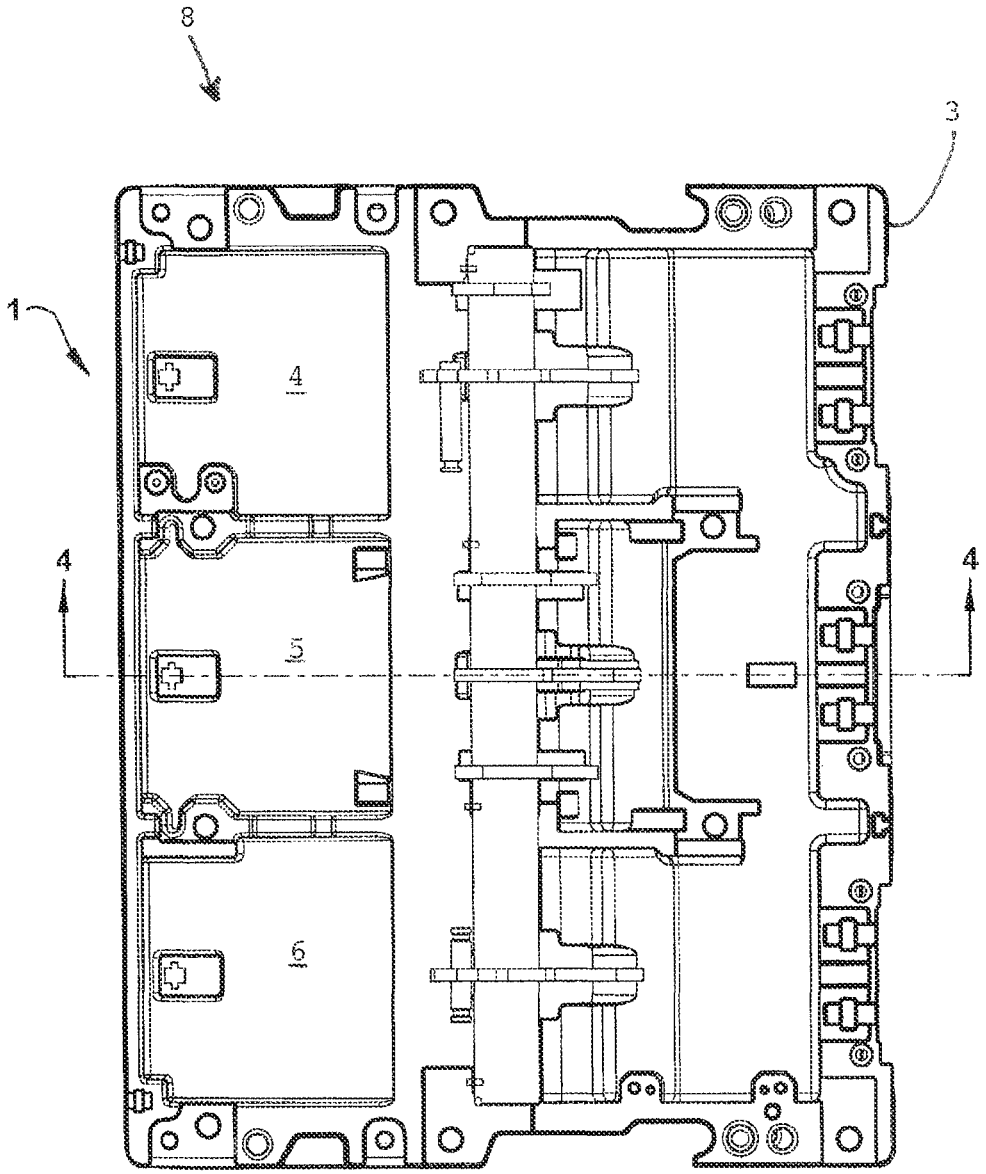
FIG. 3 is a front view of a three pole air circuit breaker that includes the pole shown in FIG. 2 and that indicates a cross section to be shown in FIGS. 4-6.

FIG. 3 is a front view of an air circuit breaker 1 that houses three poles 110 shown in FIG. 2. Section 4-4 is indicated in FIG. 3 and will be used for the cross section views of a pole 110 shown in FIGS. 4-6. The pole 110 can be seen positioned within a pole chamber 5 with the contacts 20 in an arc chamber 13. The arc chamber 13, which is substantially closed so that it can be pressurized, includes an outlet 18 through which arc gases may pass. In FIG. 4 the contacts 20 are in the second position, as are the other movable elements. In the closed, second position current may be conducted from the stationary contact assembly 25 to the load connector assembly 65. The contact fingers 47 on the moveable contact assembly 45 are positioned so that the moveable contacts 42 are directly coupled to the stationary contacts 27. Springs 74 urge the con act fingers 47 into the closed position.

The moveable contacts 42 are fixed to the contact fingers 47 about midway between the pivot pin 53 and a first or free end 41. A shunt connection feature 49 on the contact fingers 47 is adapted to be connected to a flexible shunt (not shown) that connects the contact fingers 47 to the load conductor connector assembly 65. Adjacent to the free end 41 of the contact fingers is an arc toe 43 that forms a moveable arcing contact which cooperates with an arc runner 34 to guide the arc into an arc chute 17 in the arc chamber 13 to be extinguished. The moving seal 150 is also pivotally mounted to the pivot pin 53 on the contact carriage 40'. In the second position, the moving seal 150 is positioned substantially below the stationary contact 27.

FIG. 5 illustrates the circuit breaker pole 110 as it begins to open in response to rotation of the shaft 33 that acts upon the linkage between the lobe 35 and link 37 to rotate the contact carriage 40'. An arc chamber inlet 16 is created by the movement of the contact carriage 40'. The contact carriage 40' begins to rotate counter clockwise and the springs 74 rock the contact fingers 47 clockwise so that arc toe 43 contacts the arc runner 34 while the moveable contacts 42 are separated from the stationary contact 27. Continued rotation of the contact carriage causes the moving seal 150 to rotate up toward the stationary contacts 27 to the position shown in FIG. 5. The moving seal 150 is positioned to seal between the contact fingers 47 and to place the arc creepage surface 152 just below the stationary contact 27 to close off the arc chamber inlet 16 so that the arc can be extinguished.

Any arc that remains between the contacts 42, 27 will have to travel the entire distance D' (FIG. 2A) presented by the concave arc creepage surface 152 before it can short to the contact fingers 47. FIG. 6 shows the pole 110 in the open position. The contact carriage 40' has rotated counterclockwise until it rests against a stop 165 in the housing. The moveable contacts 42 are separated from the stationary contact 27 and the arc toe is also separated from the arc runner 34.

To the extent that the term "or" is employed in the detailed description or claims (e.g., A or B) it is intended to mean "A or B or both," The term "and/or" is used in the same manner, meaning "A or B or both," When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage, 624 (2d. Ed. 1995).

What is claimed is:

1. A moving seal for a circuit breaker, said circuit breaker including a housing assembly and a number of pairs of separable contacts, said housing assembly defining a number of generally tubular pole chambers, wherein each pair of said separable contacts includes a stationary first contact and a movable second contact, wherein each second contact moves between an open, first position and a closed, second position, each pair of separable contacts disposed in an associated pole chamber, said moving seal comprising:

a body, said moving seal body disposed in said pole chamber and disposed adjacent said number of pairs of separable contacts;

said moving seal body including two lateral sides and a sealing portion, said sealing portion disposed between said lateral sidewalls and defining an arc creepage surface;

said arc creepage surface disposed facing said separable contacts;

wherein said arc creepage surface defines an extended surface;

wherein said arc creepage surface includes a concave portion;

said moving seal body includes an upper sidewall and a lower sidewall; and wherein said arc creepage surface concave portion is an arcuate surface that extends substantially between said moving seal body upper sidewall and said lower sidewall.

2. The moving seal of claim 1 wherein said arc creepage surface includes a planar portion, said arc creepage surface planar portion extending generally perpendicular to the plane of separation of the separable contacts.

3. The moving seal of claim 1 wherein said arc creepage surface concave portion is generally smooth.

4. The moving seal of claim 1 wherein said arc creepage surface concave portion includes a number of generally lateral grooves.

5. The moving seal of claim 1 wherein, when said separable contacts are in said first position, said arc creepage surface defines a medial wall within a pole chamber.

6. A moving seal for a circuit breaker, said circuit breaker including a housing assembly and a number of pairs of separable contacts, said housing assembly defining a number of generally tubular pole chambers, wherein each pair of said separable contacts includes a stationary first contact and a movable second contact, wherein each second contact moves between an open, first position and a closed, second position, each pair of separable contacts disposed in an associated pole chamber, said moving seal comprising:

a body, said moving seal body disposed in said pole chamber and disposed adjacent said number of pairs of separable contacts;

said moving seal body including two lateral sides and a sealing portion, said sealing portion disposed between said lateral sidewalls and defining an arc creepage surface;

said arc creepage surface disposed facing said separable contacts;

wherein said arc creepage surface defines an extended surface;

wherein said arc creepage surface includes a concave portion;

said arc creepage surface is generally planar with a number of generally lateral grooves; and each said groove defining a concave portion.

7. The moving seal of claim 6 wherein said grooves are defined by one of a number of ridges extending from said generally planar arc creepage surface, or, a number of channels in said generally planar arc creepage surface.

8. The moving seal of claim 7 wherein, when said separable contacts are in said first position, said arc creepage surface defines a medial wall within a pole chamber.

9. A circuit breaker comprising:

a housing assembly, said housing assembly defining a number of generally tubular pole chambers;

a number of pairs of separable contacts;

each said pair of separable contacts includes a stationary first contact and a movable second contact, wherein each second contact moves between an open, first position and a closed, second position;

each said pair of separable contacts disposed in an associated pole chamber;

a number of moving seals, each moving seal including a body, each said moving seal body disposed in an associated pole chamber and disposed adjacent an associated pair of separable contacts;

each said moving seal body including two lateral sidewalls and a sealing portion, said sealing portion disposed between said lateral sidewalls and defining an arc creepage surface;

said arc creepage surface disposed facing said separable contacts;

wherein said arc creepage surface defines an extended surface;

wherein said arc creepage surface includes a concave portion relative to said separable contacts;

each said moving seal body includes an upper sidewall and a lower sidewall; and wherein each said arc creepage surface concave portion extends substantially between said body upper sidewall and said lower sidewall.

10. The circuit breaker of claim 9 wherein each said arc creepage surface includes a planar portion, each said arc creepage surface planar portion extending generally perpendicular to the plane of separation of the separable contacts.

11. The circuit breaker of claim 9 wherein each said arc creepage surface concave portion is generally smooth.

12. The circuit breaker of claim 9 wherein each said arc creepage surface concave portion includes a number of generally lateral grooves.

13. The circuit breaker of claim 9 wherein, when said separable contacts are in said first position, each said arc creepage surface defines a medial wall within a pole chamber.

14. A circuit breaker comprising:

a housing assembly, said housing assembly defining a number of generally tubular pole chambers;

a number of pairs of separable contacts;

each said pair of separable contacts includes a stationary first contact and a movable second contact, wherein each second contact moves between an open, first position and a closed, second position;

each said pair of separable contacts disposed in an associated pole chamber;

a number of moving seals, each moving seal including a body, each said moving seal body disposed in an associated pole chamber and disposed adjacent an associated pair of separable contacts;

each said moving seal body including two lateral sidewalls and a sealing portion, said sealing portion disposed between said lateral sidewalls and defining an arc creepage surface;

said arc creepage surface disposed facing said separable contacts;

wherein said arc creepage surface defines an extended surface;

wherein said arc creepage surface includes a concave portion relative to said separable contacts;

each said arc creepage surface is generally planar with a number of generally lateral grooves; and each said groove defining a concave portion.

15. The circuit breaker of claim 14 wherein said grooves are defined by one of a number of ridges extending from said generally planar arc creepage surface, or, a number of channels formed in said generally planar arc creepage surface.

16. The circuit breaker of claim 15 wherein, when said separable contacts are in said first position, each said arc creepage surface defines a medial wall within a pole chamber.

* * * * *